US008173946B1

(12) United States Patent
Patterson et al.

(10) Patent No.: US 8,173,946 B1
(45) Date of Patent: May 8, 2012

(54) METHOD OF INTERCEPTING INCOMING PROJECTILE

(75) Inventors: William N. Patterson, Tucson, AZ (US); James H. Dupont, Bowie, AZ (US); Richard D. Loehr, Tucson, AZ (US); Henri Y. Kim, Tucson, AZ (US); Garrett L. Hall, Tucson, AZ (US); James M. Cook, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 855 days.

(21) Appl. No.: 12/198,146

(22) Filed: Aug. 26, 2008

(51) Int. Cl.
*F41G 7/00* (2006.01)
*F42B 15/01* (2006.01)
*F42B 15/00* (2006.01)

(52) U.S. Cl. ..... 244/3.15; 244/3.1; 89/1.11

(58) Field of Classification Search ..... 244/3.1–3.3; 89/1.11; 102/473, 491, 494, 496, 497; 367/118, 367/127; 342/13–20, 61–67, 118, 146, 147, 342/175, 195
See application file for complete search history.

(56) References Cited

U.S. PATENT DOCUMENTS

| | | | | |
|---|---|---|---|---|
| 4,465,249 | A | 8/1984 | Selince | |
| 4,925,129 | A * | 5/1990 | Salkeld et al. | 244/3.11 |
| 5,464,174 | A * | 11/1995 | Laures | 244/3.11 |
| 5,835,869 | A | 11/1998 | Schroeder | |
| 6,543,716 | B1 * | 4/2003 | Miller et al. | 244/3.21 |
| 6,610,971 | B1 * | 8/2003 | Crabtree | 244/3.1 |
| 6,666,401 | B1 * | 12/2003 | Mardirossian | 244/3.11 |
| 6,669,477 | B2 * | 12/2003 | Hulet | 367/127 |
| 6,717,543 | B2 * | 4/2004 | Pappert et al. | 342/13 |
| 6,771,205 | B1 * | 8/2004 | Barton et al. | 342/13 |
| 6,825,792 | B1 * | 11/2004 | Letovsky | 342/14 |
| 6,920,827 | B2 * | 7/2005 | Llyod | 102/497 |
| 6,995,660 | B2 * | 2/2006 | Yannone et al. | 342/14 |
| 7,046,187 | B2 * | 5/2006 | Fullerton et al. | 342/195 |
| 7,066,427 | B2 * | 6/2006 | Chang | 244/3.19 |
| 7,104,496 | B2 * | 9/2006 | Chang | 244/3.19 |
| 7,190,304 | B1 * | 3/2007 | Carlson | 244/3.1 |
| 7,202,809 | B1 * | 4/2007 | Schade et al. | 244/3.1 |
| 7,205,932 | B2 * | 4/2007 | Fiore | 342/147 |
| 7,851,732 | B2 * | 12/2010 | Brinkerhoff et al. | 244/3.21 |

FOREIGN PATENT DOCUMENTS

| | | | |
|---|---|---|---|
| DE | 102004037235 | A1 | 3/2006 |
| GB | 2316663 | A | 3/1998 |
| WO | 2008048702 | A2 | 4/2008 |

* cited by examiner

*Primary Examiner* — Bernarr Gregory
(74) *Attorney, Agent, or Firm* — Renner, Otto, Boisselle & Sklar, LLP

(57) ABSTRACT

A method of defeating an incoming missile, such as a rocket propelled grenade, includes soft launching an interceptor missile, and then using pitch over motors of the interceptor missile to alter course of the missile to a desired interception direction. By launching at a relatively slow speed, such as a speed less than or equal to 40 m/sec (130 ft/sec), the interceptor missile may reach the desired interception direction within 250 milliseconds of launch. The interceptor missile may be able to cover substantially all interception directions over a hemisphere or greater extent around a launch location. For example, the interceptor missile may be launched vertically from a ground vehicle, and be capable of altering course to any above-ground trajectory within 250 milliseconds.

19 Claims, 3 Drawing Sheets

METHOD OF INTERCEPTING INCOMING PROJECTILE

BACKGROUND OF THE INVENTION

1. Technical Field of the Invention

The invention is in the field of devices and methods for defending against incoming projectiles.

2. Description of the Related Art

Rocket propelled grenades (RPGs) are examples of a type of projectile that poses a great threat to ground vehicles, aircraft, and helicopters. RPGs are commonly used during close-in military engagements, where the shooter and the target are close to one another. Defending against such incoming projectiles presents a difficult problem. From the foregoing it will be appreciated that it may be desirable to have improved ways of dealing with incoming projectiles.

SUMMARY OF THE INVENTION

According to an aspect of the invention, a method of intercepting an incoming projectile includes soft launching an interceptor missile, and altering course of the interceptor missile within 250 milliseconds to an interception course for intercepting the incoming projectile.

According to another aspect of the invention, a method of intercepting a projectile includes the steps of: determining a desired interception direction for an interceptor missile; launching the missile in a given direction at a speed less than or equal to 40 m/sec (130 ft/sec); and altering course of the missile to the desired interception direction for intercepting the projectile, wherein the altering course is substantially accomplished within 250 milliseconds of launch.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A method of defeating an incoming missile, such as a rocket propelled grenade, includes soft launching an interceptor missile, and then using pitch over motors of the interceptor missile to alter course of the missile to a desired interception direction. By launching at a relatively slow speed, such as a speed less than or equal to 40 m/sec (130 ft/sec), the interceptor missile may reach the desired interception direction within 250 milliseconds of launch. The interceptor missile may be able to cover substantially all interception directions over a hemisphere or greater extent around a launch location. For example, the interceptor missile may be launched vertically from a ground vehicle, and be capable of altering course to any above-ground trajectory within 250 milliseconds.

Figure 1:
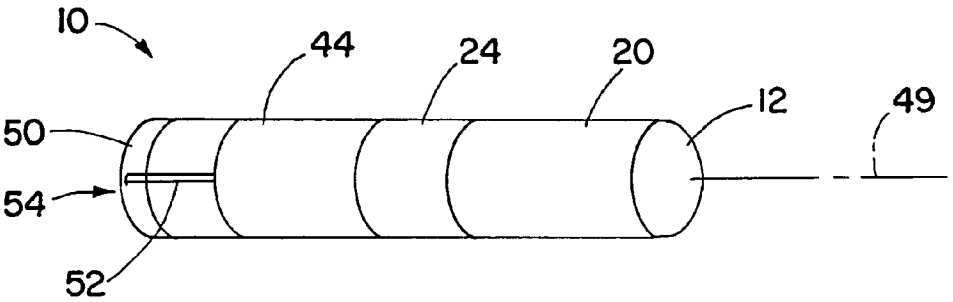
FIG. 1 is a side view of an interceptor missile in accordance with an embodiment of the present invention.
Figure 2:
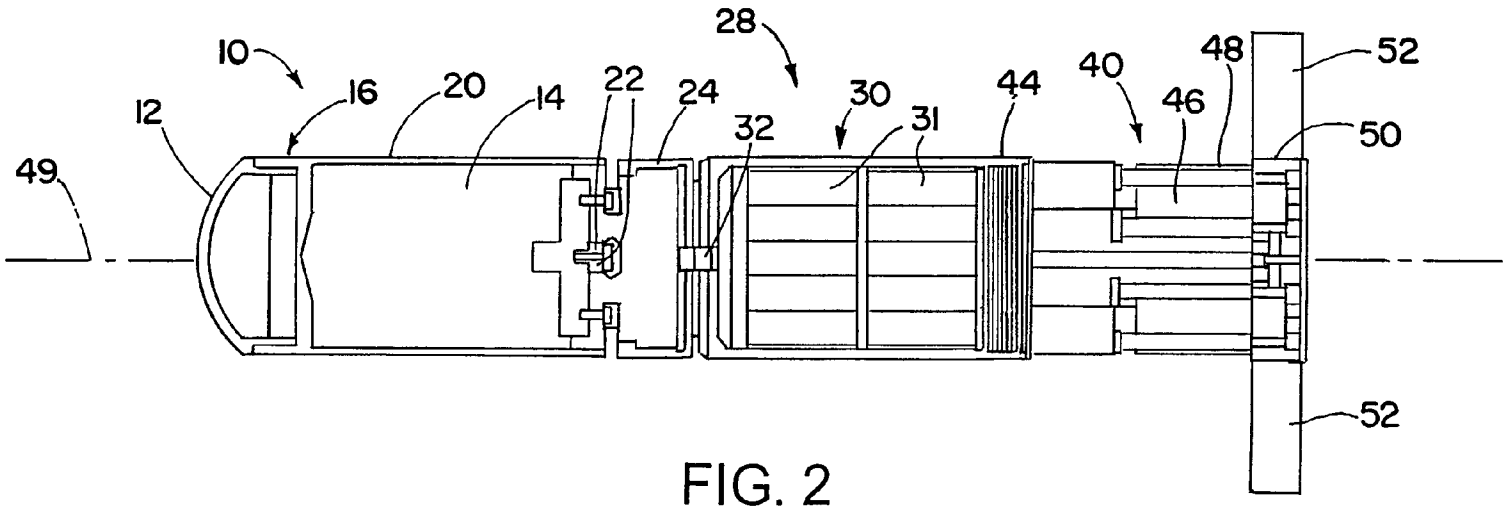
FIG. 2 is a side sectional view of the interceptor missile of FIG. 1.

Referring initially to FIGS. 1 and 2, an interceptor missile 10 is used for intercepting an incoming projectile, such as a rocket propelled grenade (RPG). As described in greater detail below, the interceptor missile 10 is soft launched in a predetermined orientation, such as vertically up or vertically down. The course of the missile is then altered to a desired interception direction. This altering of course may be substantially accomplished over a wide range of possible directions, such as a hemisphere of directions relative to the launch direction, over a time of 250 milliseconds or less. The interceptor missile 10 is then accelerated toward the incoming missile or projectile.

At its front end the interceptor missile 10 includes a dome 12 which covers a warhead 14 and warhead fragments 16. The interceptor missile 10 is configured to detonate the warhead 14 at a predetermined time after launch. This propels the fragments 16 out the forward end of the missile 10, displacing the dome 12. Warhead fragments 16 collide with the incoming missile or projectile and damage the incoming missile or projectile, preventing it from reaching its intended target.

The warhead 14 and the warhead fragments 16 are enclosed in a tubular forward body 20. The body 20 is capped at its front end by the dome 12. An igniter 22 in a middle body 24 is used to detonate the warhead 14. It will be appreciated that the igniter 22 may be controlled by suitable control logic within the middle body 24. Control logic may include, for example, integrated circuits that are used to control the timing of the firing of the igniter 22. Control logic may also be used to control the propulsion system of the interceptor missile 10.

A propulsion system 28 of the interceptor missile 10 is located in the aft half of the missile. The propulsion system 28 includes a solid rocket motor 30, with multiple propellant grains 31, which provide the main propulsion system for acceleration or boost of the interceptor missile 10. The solid rocket motor 30 may include conventional solid rocket fuel, configured so as to burn quickly when ignited. The solid rocket motor 30 may be ignited by a boost igniter 32. The boost igniter 32 is at an opposite end of the middle body 24 from the warhead igniter 22. Pressurized gas produced by combustion of the solid rocket motor 30 is directed rearward through a main boost nozzle 36 at the aft end of the interceptor missile 10.

The interceptor missile 10 also has a series of pitch over motors 40 for altering the orientation and course of the interceptor missile 10. In the illustrated embodiment the interceptor missile 10 has four pitch over motors 40 axisymmetrically spaced around the back or aft end of the circumferential perimeter of a back or aft body 44. The back or aft body 44 includes not only the pitch over motors 40, but also the solid rocket motor 30. The pitch over motors 40 each include pitch over motor fuel 46, and a pitch over motor thrust chamber 48. The pitch over motors 40 provide thrust substantially perpendicular to an axis 49 of the interceptor missile 10. The pitch over motor fuel 46 may be a solid fuel that may be identical to the fuel used in the solid rocket motor 30. It will be appreciated that a suitable ignition device may be used for igniting the pitch over motor fuel 46 as necessary. Pressurized gases from the burning of the pitch over motor fuel 46 are received through the pitch over motor thrust chamber 48, and exit out through pitch over motor openings 50. The pitch over motor openings 50 are circular or other suitable-shape openings along a circumference or perimeter of the back or aft body 44.

The pitch over motors 40 may each have substantially the same impulse, and each may be substantially identical. The control of orientation of the missile 10 may be accomplished by controlling the timing of the firing of the pitch over motors 40. For example, a small rotation in a given axis may be obtained by closely spacing in time the firings of a pitch over motor and its diametrically-oppose counterpart. Greater rotation of the missile about the axis may be obtained by increasing the time between firings of diametrically-opposed motors. Since the diametrically-opposed motors have substantially the same impulse, there will be no residual rotation of the missile after both pitch over motors have completed their burns. It will be appreciated that use of the pitch over motors 40 such as described above advantageously does not require any additional control of the pressurized gasses (such as by a variable nozzle) other than by control of the timing of the ignition of the pitch over motors 40.

The interceptor missile 10 also may have a series of deployable fins 52 that deploy from slots 54 in the aft body 44. The fins 52 stabilize the interceptor missile 10. The fins 52 may be axisymmetrically deployed around the circumference of the aft body 44 at substantially the same longitudinal location as the pitch over motor openings 50. There may be the same number of fins 52 as pitch over motor openings 50. Alternatively, and especially for short-range missiles, the fins may be omitted.

The interceptor missile 10 may weigh 5.7 kg (12.5 pounds), may be 46 cm (18 inches) long, and may have a diameter of 8.9 cm (3.5 inches). It will be appreciated that these are only values for a single embodiment, and that the weight and dimensions of the interceptor missile 10 may vary over a wide variety of values.

Figure 3:
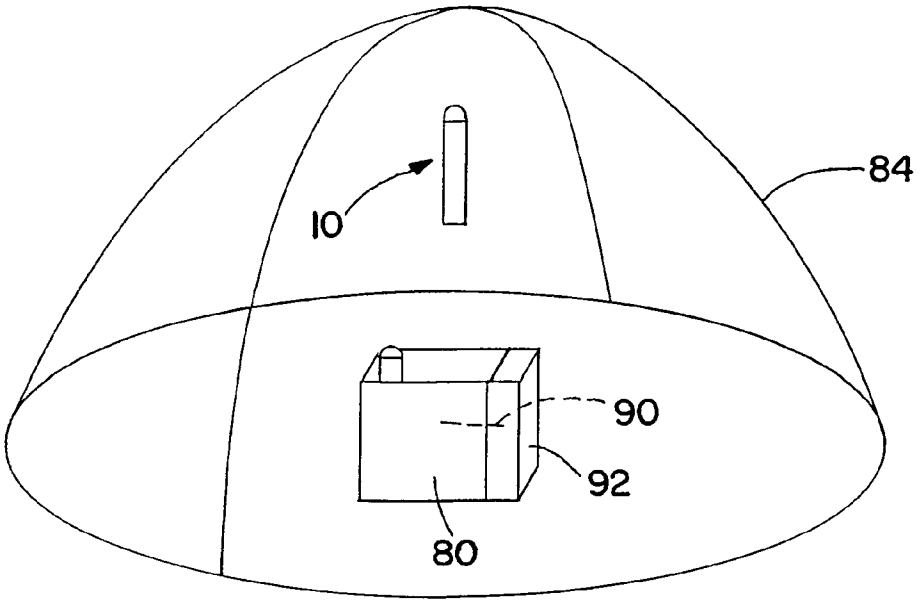
FIG. 3 is an oblique view illustrating a soft launching process of the interceptor missile of FIG. 1.

FIG. 3 illustrates the launching process for the interceptor missile 10. The missile is soft launched from a launcher 80. "Soft launch," as the phrase is used herein, refers to launching without firing of a propulsion system of the interceptor missile 10. The launcher 80 may use a pressurized gas launch system to soft launch the missile 10, for example by using pressurized expanding gases, from the missile or cannister from a separate system, to provide lift to the missile. Soft launching allows for a smoother launch of the interceptor missile 10, with less tip over relative to a hard launch that involves emission of pressurized gases from the missile while the missile is still in the launcher. An example of a system for soft launching is the pressurized gas launcher described in co-owned patent application Ser. No. 12/135,512, filed Jun. 6, 2008, which is incorporated herein by reference.

The soft launch of the interceptor missile 10 enables a faster and more predictable transition to a desired interception course for intercepting an incoming missile or projectile. Using the pitch over motors 40 (FIG. 2), the missile 10 is able to quickly redeploy from a predetermined initial launch trajectory 82 (FIG. 3) to substantially any trajectory within at least a hemisphere 84 (FIG. 3) about the launch trajectory 82. Even more broadly, the interceptor missile 10 may be capable of redeploying over more than merely the hemisphere 84. The interceptor missile 10 may be capable of deploying over substantially a full circle, to any trajectory, even a downward trajectory vertically upward launch shown in FIG. 3. While altering course over a hemisphere may be sufficient for launching in a vertical trajectory from the ground as shown in FIG. 3, it will be appreciated that it may be desirable for other situations to be able to deploy about a full sphere. For example it may be desirable for an air-launched interceptor missile to be able to launch upward or downward and still be able to quickly engage incoming targets fired from both lower and higher altitudes.

The pitch over motors 40 may be such as to be able to deploy interceptor missile 10 to a desired interceptor trajectory within 250 milliseconds of launch from the launcher 80. The pitch over motors 40 may be strong enough to provide at least 2,000° per second of rotation to the interceptor missile 10. The pitch over motors 40 may be sufficiently strong to provide at least 6,000° or 7,000° per second of rotation to the interceptor missile 10.

The interceptor missile 10 may be coupled by an umbilical 90 (FIG. 3) to a launcher controller 92. This allows the interceptor missile 10 to receive continuous updates regarding the position, velocity, and/or other characteristics of incoming missiles or projectiles. Such information may be utilized by internal control logic of the interceptor missile 10 to aid in setting the course of the interceptor missile 10, through use of the pitch over motors 40. The umbilical 90 may be a wire or cable that feeds out and allows the interceptor missile 10 to be connected to the launcher controller 92 during launch. It will be appreciated that further details concerning umbilical connections or missiles in flight may be found from descriptions of prior art wire-guided missiles. As another alternative, the umbilical 90 may be omitted.

The launcher controller 92 may obtain information regarding incoming missiles or projectiles from suitable sensors, or from other equipment, such as radar devices. Information may be communicated to the controller 92 by any of a variety of ways, including radio signals. The launcher controller 92 may also provide communication and power to the interceptor missile 10.

The interceptor missile 10 may be an unguided missile, in that it has no control surfaces used for generating aerodynamic forces to change the course of the missile. The term "unguided," as used herein, is so defined. It will be appreciated that it is necessary for a missile to have a certain minimum velocity in order to allow for guidance with control systems. By operating in an unguided mode, with its course altered through use of the pitch over motors 40, the interceptor missile 10 is able to change course quickly even when moving at small velocity. This allows it to obtain its desired course or trajectory in a short distance. As a result, the interceptor missile 10 is able to engage incoming missiles or projectiles even when such incoming missiles or projectiles are fired close to the launch location of the interceptor missile 10.

Figure 4:
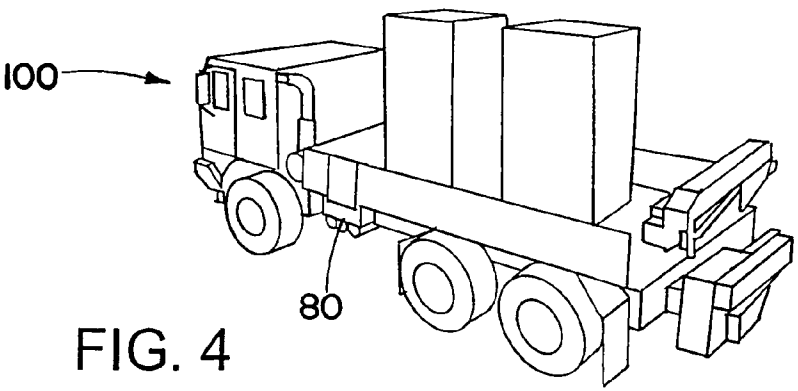
FIG. 4 is an oblique view of a ground vehicle having a launcher attached for launching the interceptor missiles of FIG. 1.

FIG. 4 shows a ground vehicle 100 that has a launcher 80 attached to it. The launcher 80 is able to fire interceptor missiles 10 (FIG. 1) for defending the ground vehicle 100 (and possibly other nearby targets), against incoming missiles or projectiles. The ground vehicle 100 may be any of a wide variety of vehicles, including trucks, tanks, and personnel carriers.

Figure 5:
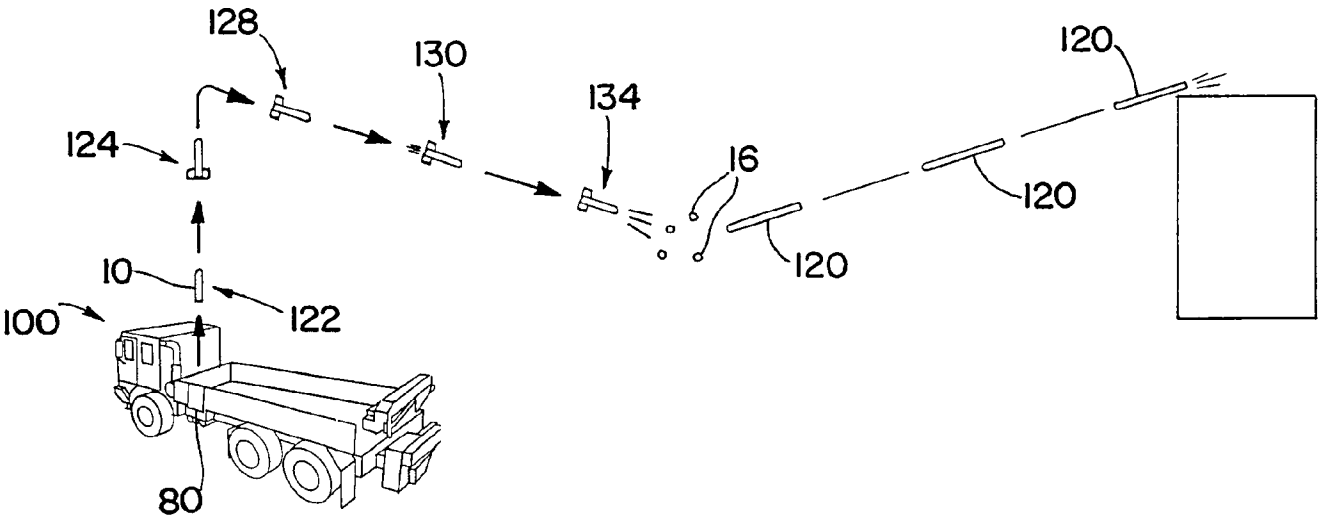
FIG. 5 is a diagram illustrating the launch and interception process using the interceptor missile of FIG. 1.

FIG. 5 illustrates the process of the interception and disabling of an incoming projectile or missile (such as an RPG) 120, fired at the ground vehicle 100. Once the projectile 120 is detected the interceptor missile 10 is fired in a soft launch, shown at reference number 122. The speed of the interceptor missile 10 when soft launched may be relatively small. If the missile 10 is soft launched at a sufficiently slow speed, then the pitch over motors 40 can provide sufficient thrust to get to any angle within a desired time and distance. Upon launch the interceptor missile 10 may have a speed of 18-37 m/sec (60-120 ft/sec). More narrowly the launch speed may be from 21 to 30 m/sec (70 to 100 ft/sec), from 21 to 27 m/sec (70 to 90 ft/sec), or about 24 m/sec (80 ft/sec). The soft launching may occur at a speed less than or equal to 30 m/sec (100 ft/sec). The soft launching may occur at a speed greater than or equal to 18 m/sec (60 ft/sec).

After the soft launch, the fins 52 deploy as shown at step 124. The deployment of the fins 52 (if present) may be automatic once the interceptor missile 10 leaves the launcher 80. The fins 52 may be spring loaded or otherwise configured to automatically deploy.

The course alteration of the interceptor missile 10 is shown at step 128. As discussed above, the course alteration is accomplished by selectively firing of the pitch over motors 40, in order to quickly and efficiently move the interceptor missile 10 onto its desired course for intercepting the projectile 120. Information regarding the desired final course, or other instructions or information, may be forwarded to the interceptor missile 10 through the umbilical 90. As discussed above, the course alteration shown at step 128 may be accomplished within 250 milliseconds.

After the desired orientation for the interceptor missile 10 has been achieved, the solid rocket motor 30 (FIG. 2) of the interceptor missile 10 is fired. This results in the boost phase shown at 130. In this phase the interceptor missile 10 greatly accelerates, speeding toward its intersection with the incoming projectile or missile 120. Velocity at motor burn out (the burn out of the solid rocket motor 30, the main boost propellant system for the interceptor missile 10) may be about 150 m/sec.

Finally, when the interceptor missile 10 is within a predetermined distance of the incoming projectile or missile 120, the missile warhead 14 (FIG. 2) detonates, as shown at 134. This violently propels the warhead fragments 16 (FIG. 2) toward the incoming projectile 120. Damage from the warhead fragments 16 disables the incoming projectile 120, preventing the projectile or missile 120 from reaching its target, the ground vehicle 100. The fragments may be of a heavy material, such as steel or tungsten.

Figure 6:
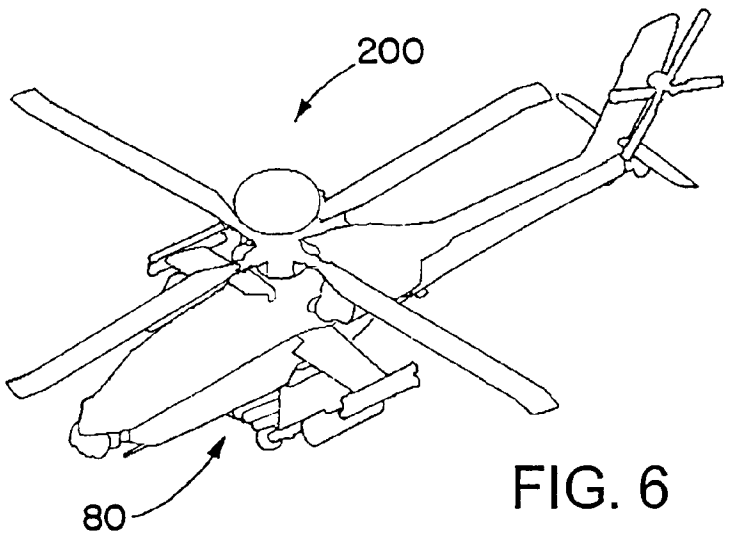
FIG. 6 is an oblique view of an air vehicle having a launcher mounted there upon for launching interceptor missiles of the type shown in FIG. 1.

FIG. 6 shows an alternate embodiment in which the launcher 80 for launching interceptor missiles 10 (FIG. 1) is mounted on an air vehicle 200. The illustrated air vehicle 200 is a helicopter. However, it will be appreciated that launchers may be mounted on other types of air vehicles to protect the air vehicles from incoming missiles or projectiles. Examples of other types of air vehicles include airplanes, gliders, drones, and balloons. The launcher 80 may be configured to launch the interceptor missiles 10 in a vertically up direction, a vertically down direction, or some other predetermined direction. As a further alternative, the launcher may be mounted on a sea vehicle, or on a stationary (though perhaps temporary or movable) structure.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of intercepting a projectile, the method comprising:

determining an interception direction for an interceptor missile;

launching the missile in a given direction at a nonzero speed less than or equal to 40 m/sec; and altering course of the missile, accomplished within 250 milliseconds of launch, to the interception direction for intercepting the projectile.

2. The method of claim 1, wherein the determining includes determining the interception direction from a range of possible interception directions that includes substantially all directions emanating from a launch location from which the missile is launched.

3. The method of claim 1, wherein the launching includes launching the missiles at a speed less than or equal to 30 m/sec.

4. The method of claim 1, wherein the launching includes launching the missiles at a speed greater than or equal to 18 m/sec.

5. The method of claim 1, wherein the launching includes launching the missiles at a speed from 21 to 27 m/sec.

6. The method of claim 1, wherein the altering includes selectively firing pitch over motors of the missile.

7. The method of claim 6, wherein the pitch over motors provide thrust in a direction perpendicular to a missile axis of the missile.

8. The method of claim 7, wherein the missile pitch over motors includes at least four motors.

9. The method of claim 8, wherein the at least four motors include two pairs of motors, wherein for each of the pairs the motors are diametrically opposed to one another.

10. The method of claim 1, wherein the launching the missile includes launching the missile from a ground vehicle.

11. The method of claim 10, wherein the launching includes launching the missile in a substantially vertical upward direction.

12. The method of claim 1, wherein the launching the missile includes launching the missile from an air vehicle.

13. The method of claim 12, wherein the launching includes launching the missile in a substantially vertical downward direction.

14. The method of claim 1, wherein the launching includes non-explosively soft launching the missile.

15. The method of claim 14, further comprising, after the soft launching, firing a booster motor of the missile to accelerate the missile.

16. The method of claim 15, wherein the firing the booster motor occurs after the altering course of the missile.

17. The method of claim 16, further comprising detonating a warhead of the missile, wherein the detonating occurs after the firing of the booster motor.

18. The method of claim 14, wherein the launching includes launching the missile with an umbilical attaching the missile to the launcher.

19. A method of intercepting a projectile, the method comprising:

launching a missile in a given direction at a nonzero speed less than or equal to 40 m/sec; and altering course of the missile, accomplished within 250 milliseconds of launch, to an interception direction for intercepting the projectile.

* * * * *